US005639178A

United States Patent [19]

Wilson et al.

[11] Patent Number: 5,639,178

[45] Date of Patent: Jun. 17, 1997

[54] VEHICLE BARRIER

[75] Inventors: Ian Wilson, Bedford; Nicholas John Stewart White, Luton, both of Great Britain

[73] Assignee: George Fisher Castings Limited, Bedford, Great Britain

[21] Appl. No.: 436,432

[22] PCT Filed: Nov. 18, 1993

[86] PCT No.: PCT/GB93/02371

§ 371 Date: May 26, 1995

§ 102(e) Date: May 26, 1995

[87] PCT Pub. No.: WO94/12731

PCT Pub. Date: Jun. 9, 1994

[30] Foreign Application Priority Data

Nov. 27, 1992 [GB] United Kingdom ..... 9224887

[51] Int. Cl.[6] ..... E01F 13/00

[52] U.S. Cl. ..... 404/6; 49/35; 49/49; 49/131

[58] Field of Search ..... 404/6, 9, 10, 11; 256/1, 13.1; 49/35, 49, 131

[56] References Cited

U.S. PATENT DOCUMENTS

| | | | |
|---|---|---|---|
| 4,490,068 | 12/1984 | Dickinson | 49/49 X |
| 4,828,424 | 5/1989 | Crisp, Sr. | 49/49 X |
| 4,934,097 | 6/1990 | Quante | 49/49 |

FOREIGN PATENT DOCUMENTS

| | | | |
|---|---|---|---|
| 363241 | 4/1990 | European Pat. Off. . | |
| 2626299 | 7/1989 | France | 49/49 |
| 0363241 | 9/1989 | France . | |
| 9113867 | 11/1991 | Germany . | |
| 9113867 | 1/1992 | Germany . | |
| 238906 | 8/1992 | Japan | 49/49 |
| 2195384 | 9/1987 | United Kingdom . | |
| 2195384 | 4/1988 | United Kingdom | 49/131 |
| 9015901 | 6/1990 | United Kingdom . | |
| 90/2228 | 3/1990 | WIPO | 49/49 |
| 90/15901 | 12/1990 | WIPO | 49/49 |

*Primary Examiner*—James A. Lisehora
*Attorney, Agent, or Firm*—Oldham & Oldham Co., L.P.A.

[57] ABSTRACT

A vehicle barrier in which two arms (6, 10) linked by a linking member (14) are pivoted to a base structure (1) so that they collapse into a recess (5) in the structure to "open" the barrier. To close the barrier the arms are raised and may be latched and locked in place, the arms and structure preferably forming a triangular shape when erect.

9 Claims, 3 Drawing Sheets

VEHICLE BARRIER

TECHNICAL FIELD

The present invention relates to a vehicle barrier for controlling access to or from a vehicle park, parking space or controlled authorised zone.

BACKGROUND OF THE INVENTION

Parking spaces are frequently controlled by posts hinged to a bracket fixed to the ground. When raised they are sometimes difficult to see when reversing. When lowered they lie above the ground level with their brackets also above the ground which can trip up pedestrians. Such posts also can damage vehicles.

SUMMARY OF THE INVENTION

A vehicle barrier according to the invention comprises a bracket structure, walls of which define a recess, a first arm pivoted at one end to one end of the structure and a second arm pivoted at one end to the outer end of the structure, means for linking the first arm to the second arm, the arms being movable from a stowed position within the recess to an erect position where both arms extend upwards from the structure characterised by further comprising a means to urge at last one arm into the erect position.

Preferably the means for linking the first arm to the second arm is a member pivotally connected to the first arm and pivotally connected to the second arm. The linking member may be arranged to be latched to the second arm when erect and then locked. In the preferred embodiment the arms with linking member assume with the bracket structure a substantially triangular shape when the arms are erect. At least one arm may be provided with means such as a gas spring to urge it into an erect position. In order to relieve the weight of the second arm when unlatching, a counter balance means such as one or two pretensioned springs may be provided so as to act between the bracket structure and the second arm and to bias the second arm upwards.

In a further embodiment the gas spring is replaced by a pneumatic or hydraulic actuator so that the barrier can be remotely operated by a car park attendant or authorised driver. The invention is therefore readily adaptable for self operation to control a parking space or remote operation for the entrance or exit to a vehicle park.

BRIEF DESCRIPTION OF THE DRAWINGS

Embodiments of the invention will now be described with reference to the accompanying drawings in which.

PREFERRED EMBODIMENT

Figure 1:
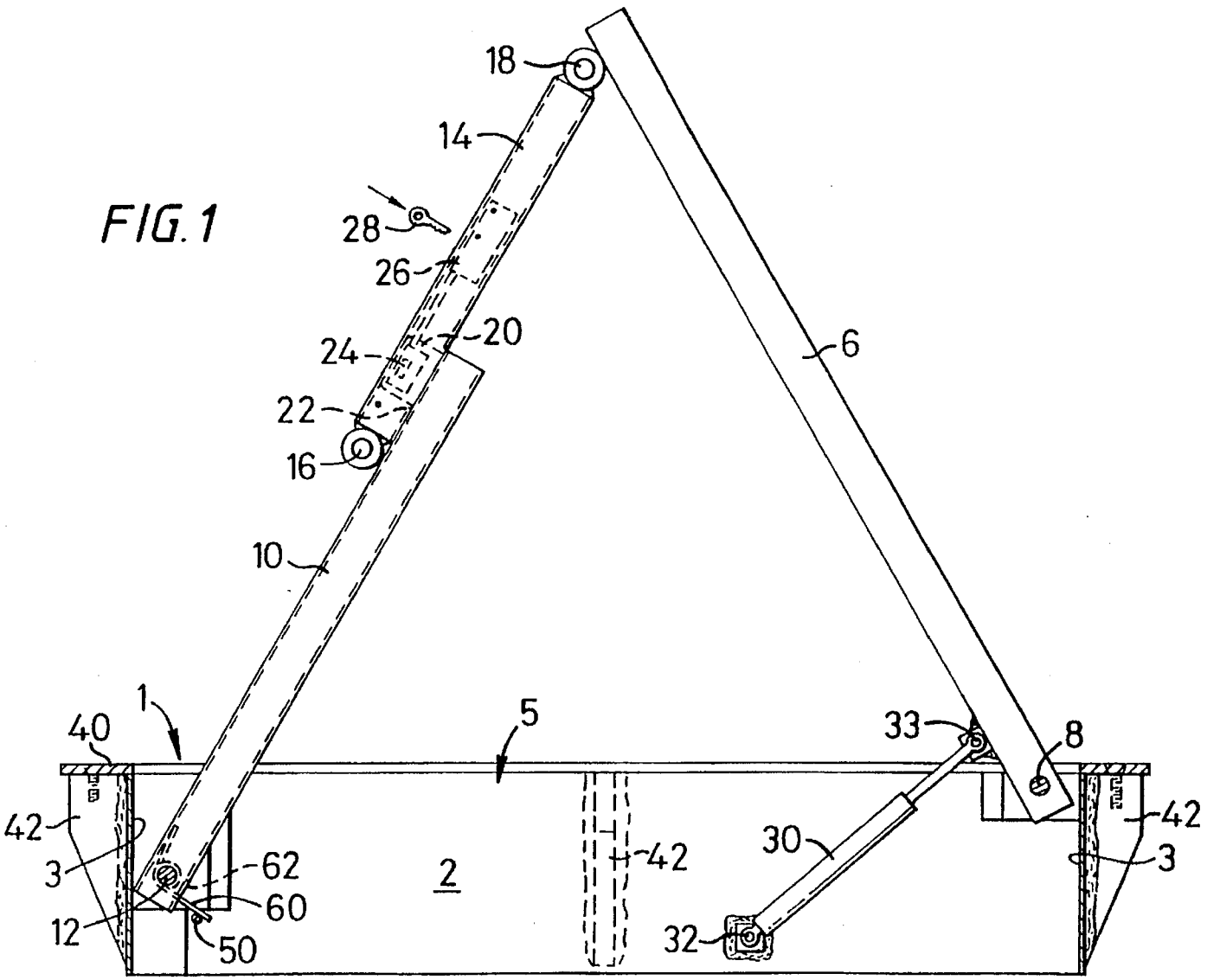
FIG. 1 is a partly sectioned side elevation of a barrier according to the invention in the erect position.
Figures 2, 5:
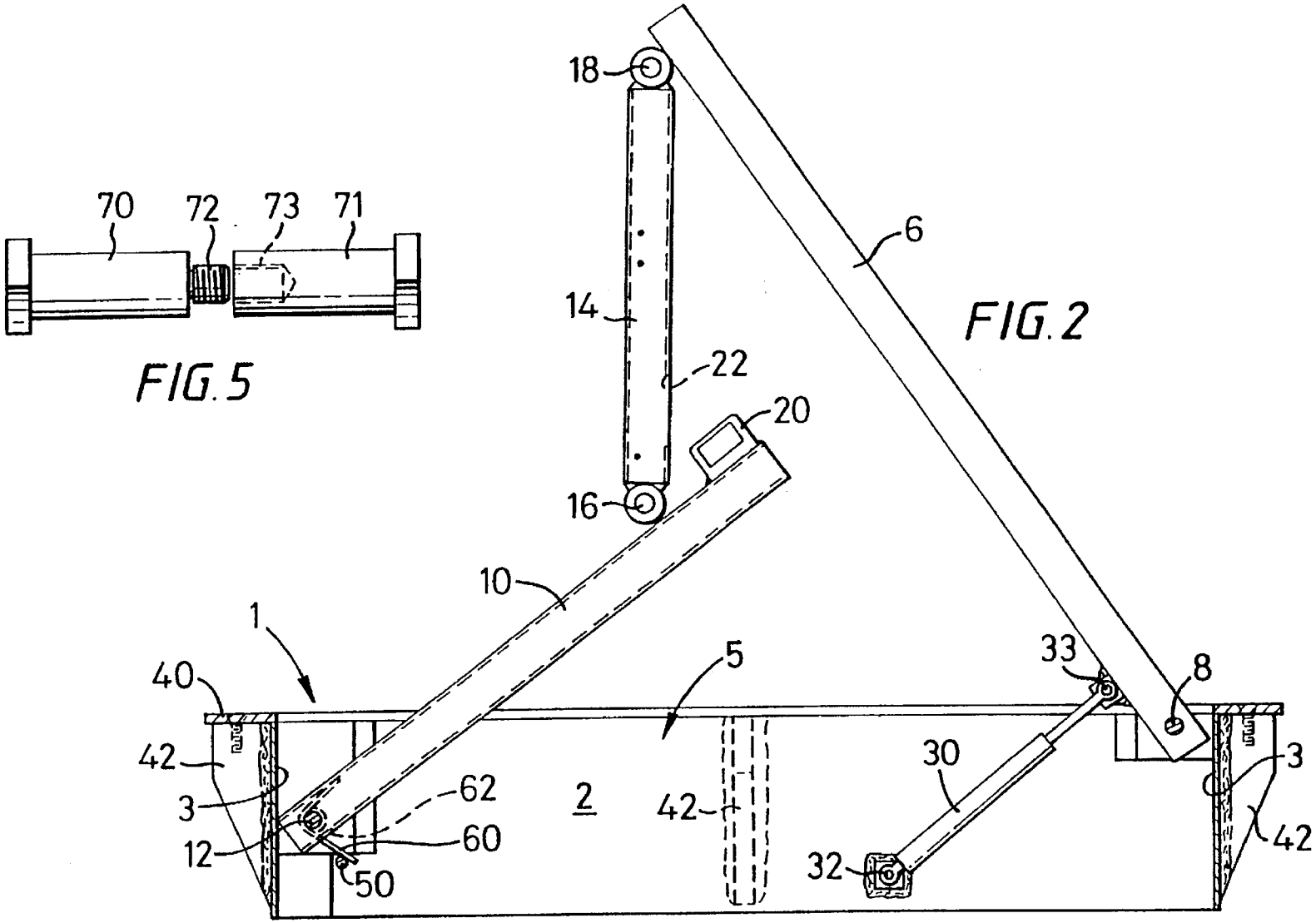
FIG. 2 is a similar elevation of the barrier of FIG. 1 in a partly erect position.
FIG. 5 is a side view of a connecting pin for the barrier of FIG. 1.
Figure 3:
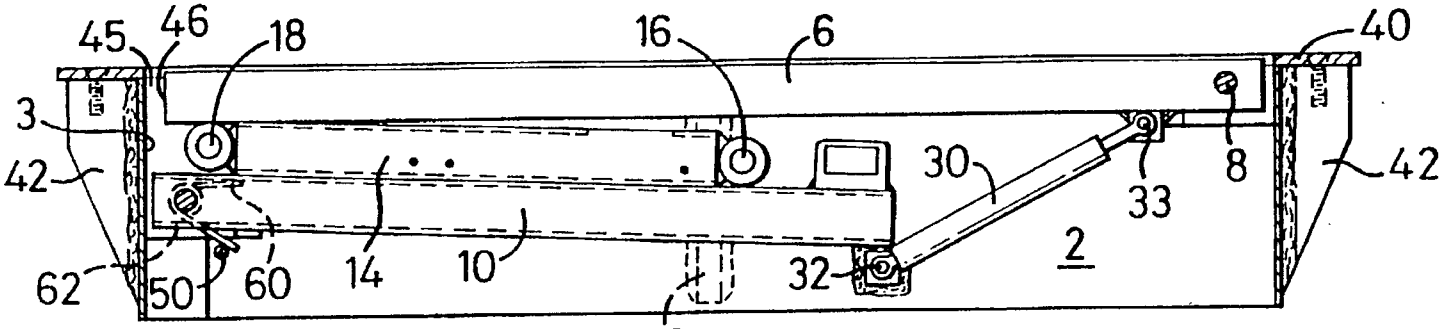
FIG. 3 is a similar elevation of the barrier of FIG. 1 in the stowed position.
Figure 4:
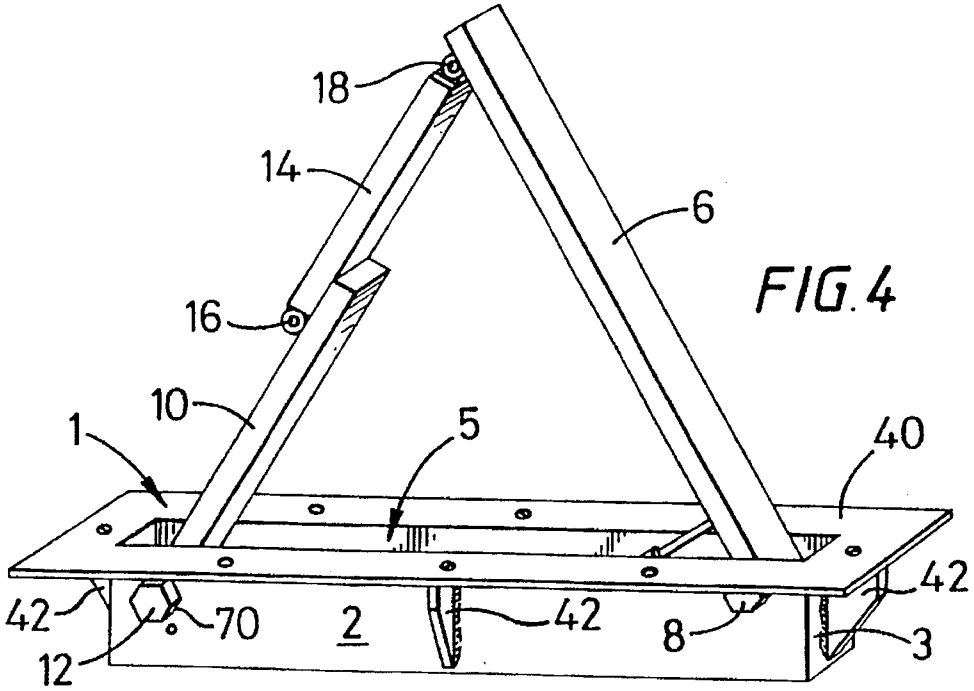
FIG. 4 is a perspective view of the barrier of FIG. 1.

The barrier comprises a bracket structure 1 having a pair of longitudinal side walls 2 and a pair of end side wails 3 which define a recess 5. A first arm 6 is pivoted at one end of the structure 8 and a second arm 10 is pivoted at the other end of the structure at 12. A linking member 14 connects the arms 6 & 10 pivotally at a point 16 towards the outer end of the second arm 10 and at a point 18 at the outer end of the first arm 6. Connecting pins formed as a male member 70 threaded at 72, and a female member 71 threaded at 73 as shown in FIG. 5 are used to form the pivot at 8 and 12.

Extending from the outer end of the second arm 10 is a latch plate 20 which is accepted when the barrier is erect into a slot 22 in the underside of locking member 14. Within the hollow section of member 14 is a latch 24 which can be locked by means of a lock 26 within the hollow section of member 14, the lock being released by a key 28 inserted through a keyhole in the upper side of member 14.

In order to bias the arms 6 and 10 upwards into the latched position is a gas spring 30, suitably of the type made by Camloc (UK) Ltd. having a force range of 150–1200 Newtons. The gas spring acts between a pivot point 32 on the structure and a pivot point 33 on the first arm. The gas spring is selected from the range of such springs such that it just overcomes the weight of the arms and linking member and ensures that a minimal force is required to collapse the barrier to its stowed position.

In order to counter balance the weight of arm 10 and to relieve any adverse strain on the lock 26, a pair of springs 60 is provided which act through slots 62 in the bottom of arm 10 between pins 50 and the inside surface of arm 10.

A plate 40 is screwed down to brackets 42 which are welded to the sides of the structure in order to support and anchor plate 40 to the structure. This can be unscrewed for maintaining the barrier. The barrier when installed is mounted within its base structure set in the ground, the plate 40 being level with the ground.

The barrier extends about 900 mm at the base and rises to a peak about 700 mm high from ground level. The recess depth is about 250 mm. It should be appreciated that the barrier extends sufficiently wide at the base to eliminate boundary posts presently provided between parking bays. The height when raised is readily visible when reversing. Visibility may be increased by providing reflective material or coating on arm 6 or member 14, or both.

To collapse the barrier it is merely necessary to unlock the latch and depress the arms against the pressure of the gas spring. On stowing there is a slight up and over action between the arms folded in recess 5. The gas spring tends to keep the arms folded in the stowed position. To raise and erect the barrier a gap 45 between one end wall 3 and outer end 46 of the first arm enables the user to put their hand into the recess and lightly ease up the first arm bringing with it the second arm and linking member. Split pins 70/71 can easily be unscrewed to remove arms 6, 10 and 14 from bracket structure 1 after removing a pin or bolt from pivot point 32.

In a second embodiment of the invention the gas spring is replaced by an actuator suitably pneumatic or hydraulic which is then connectable to an external pressure supply controlled by a car park operator or by an automatic coin fed toll system. The barrier thus constructed can then replace a lifting pole type barrier.

We claim:

1. A vehicle barrier, comprising a bracket structure having a first end and a second end, a first arm having a first end and a second end, said first end of said first arm being pivotally attached to said first end of said bracket structure and a second arm having a first end and a second end, said first end of said second arm being pivotally attached to said second end of said bracket structure, link means for linking said first arm to said second arm, said first arm and said second arm being movable from a stowed position to an erect position where said first arm and said second arm extend upwards from said bracket structure characterized by walls defining a recess into which said first arm and said second arm are movable in the stowed position and comprising an urging means for urging at least one arm into the erect position wherein in the erect position said second end of said first arm is positioned approximately over the mid point between said first end of said bracket structure and said second end of said bracket structure so that said first arm, said second arm, said link means and said bracket structure form a substantially equilateral triangle.

2. The barrier as claimed in claim 1, wherein said link means comprises a member having a first pivotal connection to said first arm and a second pivotal connection to said second arm, said first pivotal connection and said second pivotal connection being spaced apart.

3. The barrier as claimed in claim 1, wherein further including a latching arrangement and said link means is arranged to be latched to said second arm by said latching arrangement when said barrier is erect.

4. The barrier as claimed in claim 3, wherein said latching arrangement is arranged to be locked.

5. The barrier as claimed in claim 1, further comprising a counter balance means to at least partially counter balance the weight of said second arm.

6. The barrier as claimed in claim 5, wherein said counter balance means comprises at least one spring acting between said bracket structure and said second arm.

7. The barrier as claimed in claim 1, wherein said urging means is a gas spring.

8. The barrier as claimed in claim 1, wherein said urging means is an actuator.

9. The barrier as claimed in claim 1, wherean said link means is connected to said second arm at a substantial distance along the length of said second arm away from said second end of said second arm.

* * * * *